United States Patent [19]

Townsend

[11] 4,024,696

[45] May 24, 1977

[54] METHOD AND APPARATUS FOR WRAPPING MULTIPLE TAPES UPON AN ELONGATED STRUCTURE

[75] Inventor: John M. Townsend, Branford, Conn.

[73] Assignee: Magna Ply, Guilford, Conn.

[22] Filed: Dec. 15, 1975

[21] Appl. No.: 640,696

[52] U.S. Cl. ..... 57/15; 57/16; 57/17

[51] Int. Cl.[2] ..... H01B 13/10; H01B 13/08; B65H 81/08

[58] Field of Search ..... 57/3, 6, 9, 10, 11, 57/13–18, 160

[56] References Cited

UNITED STATES PATENTS

| | | | |
|---|---|---|---|
| 334,709 | 1/1886 | Kruesi et al. | 57/17 X |
| 1,579,709 | 4/1926 | Janicki | 57/17 |
| 1,734,704 | 11/1929 | Yancey | 57/17 X |
| 1,857,820 | 5/1932 | Rice | 57/16 |
| 2,023,621 | 12/1935 | Stull | 57/16 |
| 2,266,438 | 12/1941 | Nelson | 57/18 |
| 2,457,636 | 12/1948 | Bouget | 57/16 |
| 2,462,303 | 2/1949 | Bouget | 57/16 |
| 2,463,211 | 3/1949 | Spillman | 57/16 |
| 2,602,281 | 7/1952 | Bunch | 57/17 X |
| 3,439,483 | 4/1969 | Brown | 57/16 X |

*Primary Examiner*—John Petrakes
*Attorney, Agent, or Firm*—Kenyon & Kenyon Reilly Carr & Chapin

[57] ABSTRACT

The disclosure relates to a machine and apparatus for wrapping a plurality of different tapes around an elongated structure such as an electrical conductor. The multiple tapes to be wrapped are supplied by a package having a plurality of different tapes wound thereon in an universal or traverse wound arrangement. The apparatus includes at least one flyer or winding head which carries at least one supply package having a plurality of different tapes. The path of travel of the conductor extends along the axis of rotation of the winding head which in turn revolves the supply package about the conductor. The winding head further includes guides for supporting and directing the different tapes as they are simultaneously wrapped about the conductor.

26 Claims, 27 Drawing Figures

57
63
58
50a
53
54
52
49
50
51
59
61
60
64
64a
31a
31b
31'a
31'b
31'c
31'd
61a

METHOD AND APPARATUS FOR WRAPPING MULTIPLE TAPES UPON AN ELONGATED STRUCTURE

BACKGROUND OF THE INVENTION

1. Field of the Invention

The invention relates to the field of wrapping tape about an elongated structure such as an electrical conductor. More particularly the invention relates to the field of wrapping tape supplied by a package of tape which is traverse, universal or level wound. The invention relates to the field of methods and apparatus for wrapping a plurality of different tapes from one or more multiple tape supply packages about a conductor during a single pass of a conductor through a wrapping machine.

2. Description of the Prior Art

In the past variety of different methods and machines have been used for the wrapping of tape material around a length of an electrical conductor or cable. One of the methods used is the wrapping of the conductor with a single tape supplied from a pad. A pad is flat roll of tape with each turn of tape thereon completely overlapping a prior turn. In wrapping the pad is revolved concentrically or eccentrically about the circumference of the conductor to be wrapped while the conductor is advanced along its longitudinal axis. This method although quite reliable is inherently limited in rate of production since the speed of rotating the pad flyer or winding head which carries the tape pad and winds the tape around the conductor is limited by the maximum speed which the pad can withstand as it is revolved around the conductor. Overlapping of each wrap of tape also effects the production rate. For example, if a fifty percent overlap of tape on the conductor is desired the conductor must be advanced at a slower speed as compared to that where a ten percent overlap is desired.

It is also known in the art to wrap tapes around a construction such as a conductor from two or more separate pads concentrically or eccentrically mounted on a common winding head. Thus, the different tapes are applied from a plurality of pads at a single station in a rotational manner with respect to the length of the conductor or cable being wrapped. This method results in the first of a plurality of different tapes being wrapped directly around the conductor, the second tape of the plurality being wrapped directly around the first tape, and so forth.

Still another method known in the art is to wrap one or more single tapes around a conductor or cable by the use of pads of single tapes mounted on a plurality of different winding heads disposed at different stations spaced along the line of travel of the conductor or cable being wrapped. This method enables more layers of tape to be applied during a single pass of the conductor through the plurality of winding heads.

Whether a winding head carries one or a plurality of pads, the pads of tape are subjected to high rotational speed in being revolved concentrically or eccentrically around the longitudinal axis of the cable. Accordingly, the tape pads must be capable of withstanding an appreciable level of centrifugal force during the wrapping operation without coming apart. If the tape being used is comparatively narrow and if wound in a completely overlapping manner, the pad is quite unstable and can easily fall apart from the core upon which it is wound.

A pad having each layer of tape completely overlapping adjacent layers necessarily requires a large diameter pad for a large supply of tape. Due to the maximum diameter of a pad which a wrapping machine is cable of accepting, the time period of operation is severely limited by the length of tape which can be mounted on the winding head, thus limiting the length of conductor which can be wrapped before stopping the head to install new pads.

These problems have been reduced by winding the tape packages in a traverse, universal, or level wound manner, that is to say the turns of tape advance along the length of the package alternatively from one end to the other thereof. Thus as one end of the package is reached by the winding of the tape, the tape is wound toward the opposite end of the package. Traverse winding of the tape package enables an appreciable length of tape material to be furnished in a single package without having the excess diameter for the same length of tape material which would result if the tape was wound in a fully overlapping fashion into a pad. Also, a tape package which is traverse wound can better resist centrifugal and windage forces at high winding speeds.

U.S. Pat. No. 533,934, which issued on Feb. 12, 1895 discloses a traverse wound cop having a plurality of parallel threads wound in a traverse manner. This patent also discloses an apparatus for winding the cop which includes a feed mechanism and friction wheel for varying the rate of movement of the threads in the traverse direction as the diameter of the cop increases during winding.

U.S. Pat. No. 2,372,400, which issued on Mar. 27, 1945, discloses traverse winding of strands or yarns of fibres of silk, cotton or the like, wherein one turn of a plurality of adjacent strands is partially overlapping upon the previous turn of a plurality of adjacent strands in order to interlock the strands on the package.

Machines for wrapping electrical conductors with a plurality of tapes each from a different pad of tape are manufactured by Aimco Division of The Entwistle Company, Bigelow Street Hudson, Mass. 01749. This company manufactures a Concentric Pad Type Taping Machine in which a single flyer or winding head at a single taping station carries as many as four pads, each having a single tape, mounted concentrically with the axis of rotation of the winding head. Such a machine can wrap a conductor with a pair of tapes from one pair of pads in an overlapping relationship such as half lapped and a second pair of tapes from another pair of pads, again in an overlapping relationship such as half lapped.

The Aimco Division manufactures an Eccentric Pad Type Tape Machine having a winding head with a number of different pads mounted about the periphery of the head with each pad having a single tape. Such a machine can apply, by way of example, four different tapes, each from a different one of four separate pads.

Aimco Division also manufactures a Concentric Cop Type Tape Machine which wraps a single tape from a traverse or universal wound supply package having its core disposed about the axis of rotation of the winding head.

SUMMARY OF THE INVENTION

An object of the invention is to provide a tape supply package, spool or cop having a plurality of different tapes traverse wound thereon.

Another object of the invention is to provide a method and apparatus for winding the tape supply package of the invention.

A further object of the invention is to provide a machine and method for simultaneously applying a plurality of different tapes to an elongated structure such as an electrical conductor.

An additional object of the invention is to provide a wrapping for an elongated structure in which the wrapping comprises two or more different tapes simultaneously applied to the structure.

The invention is directed to packages, often referred to as cops or spools, of a plurality of different tapes, the method and apparatus for making and using such packages in the wrapping of elongated structures such as conductors or cables with such tape material, and the resulting wrapped structure.

The supply package of the invention comprises a plurality of different tapes simultaneously traverse wound with the tapes in a given turn thereof being spaced apart, abutting or partially overlapping one another. The supply package is wound on a winding machine having a multiple tape guiding head and a multiple tape feed. The guiding head has a plurality of slots or channels for guiding the individual tapes of the plurality of tapes simultaneously into the pad in a predetermined relationship.

The packages are placed in an apparatus for wrapping the tape around an elongated conductor. The wrapping apparatus or machine includes a device for guiding the plurality of different tapes during the application of the tapes and onto a conductor from traverse wound multiple tape packages. The guiding device is mounted on a rotating winding head of a wrapping machine. The winding head also carries the multiple tape supply package or packages. The multiple guide device comprises end plates with guide bushings spaced apart from one another by a plurality of rods symmetrically spaced around the plates. Slidingly mounted on each rod is an adjustable tape guide which is adapted to accept one of the plurality of tapes from a traverse wound tape package. In operation the conductor being wrapped extends through the center of the end plates parallel to the rods.

During wrapping of the conductor, the guide device as well as the multiple wound tape package are rotated around the longitudinal axis of the conductor by the winding head as the conductor moves through the guiding device, thereby effecting a wrapping of the conductor.

BRIEF DESCRIPTION OF THE DRAWINGS

For a fuller understanding of the invention reference is made to the following description taken in connection with the accompanying drawings of the preferred embodiment in which:

FIG. 3 is a front elevational view of the guide device showing the threading of the tapes from a multiple tape supply package;

DESCRIPTION OF THE PREFERRED EMBODIMENT

In the embodiment described herein, the method and apparatus of the invention is employed to wrap tape around an electrical conductor being in a strip-like form having a rectangular cross-section. The method and apparatus can be used in wrapping elongated constructions having various different traverse cross-sections. By way of example, the conductor being wrapped is of the type used in the windings of a power transformer of the type used by a public utility. The conductors are wrapped with layers of tape in order to prevent contact of one conductor within the transformer with another. Thus, in a typical application the wrapped conductors are separated by the wrapping and are electrically insulated from one another by the tape wrapping and by transformer oil surrounding the conductors. In such an application the tape material can be rope fiber which comprises approximately 90% hemp material and 10% pulp material, kraft paper, or other suitable insulating materials. Thermally ungraded rope fiber material and various other papers which can withstand a temperature rise of approximately 65° C can also be used. In addition, where higher temperatures are encontered, the conductors can be wrapped with tape insulating material, one type of which consists of nylon fibers and is marketed by E. I. DuPont DeNemours of Wilmington, Del., under the trademark NOMEX.

Depending upon the particular application, the multiple partially overlapping tapes can be applied by one or more winding heads of the wrapping machine. For example, a wrapping machine having double winding heads can be provided with a tape supply package of four tapes on the first winding head and a tape supply package of three tapes on the second winding head. As a result the conductor is wrapped with a total layer of seven tapes comprising the sum of four overlapping tapes plus three overlapping tapes. Various combinations of the number of tapes in each multiple tape supply package and the number of winding heads on the wrapping machine provide an appreciable range of the number of total tapes which can be applied to the conductor during a single pass through the wrapping machine. The total number of tapes could extend to at least as high as 65 or 70 tapes.

Figure 1:
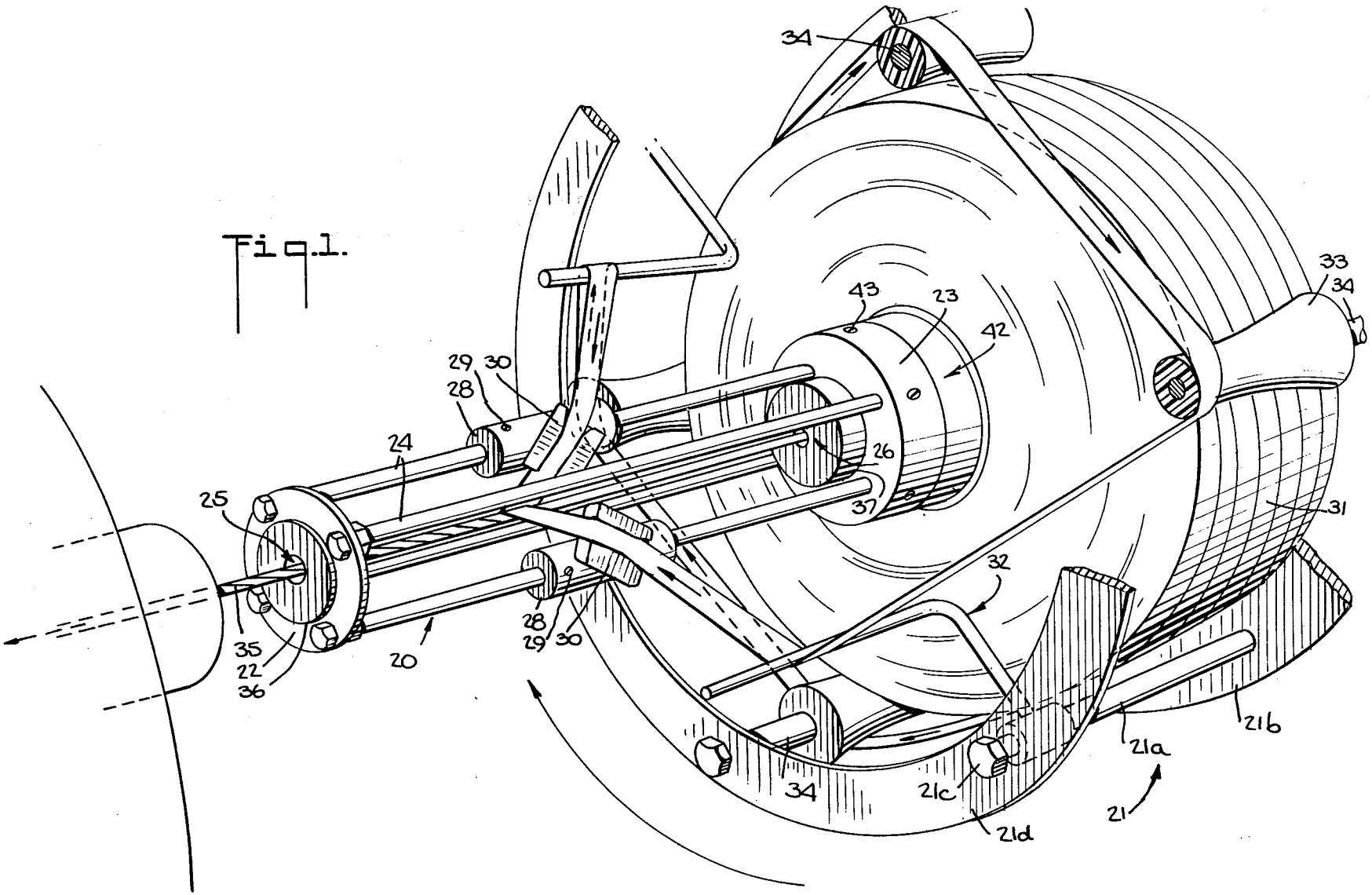
FIG. 1 is a perspective view of the multiple tape guide device of the invention for use with a multiple tape supply package mounted on the winding head of a wrapping machine.

Referring now more particularly to the accompanying drawings wherein like numerals designate similar parts throughout the various views, attention is directed first to FIG. 1 wherein the guiding head 20 of the present invention is shown mounted on the winding head of a cable or conductor wrapping machine. The guide device 20 of the present invention comprises two circular end plates 22 and 23. These end plates are connected to one another in axial alignment and parallel to one another by a plurality of rods 24. In the center of end plates 22 and 23 which can be formed of low friction material are apertures 25 and 26, respectively, The apertures are in axial alignment with one another and are of a size to receive and yet clear the elongated conductor 35 being wrapped to pass through them. Slidably mounted on rods 24 are guide holders 28. The guide holders are adapted to be positioned along rods 24 and then to be locked in a predetermined position relative to each other by means of set screws 29. The position at which the guide holders 28 are positioned and secured on rods 24 relative to each other determines the amount of tapes partially overlapping one another when wrapped around the elongated conductor. Guides 30 in turn are pivotally mounted on guide holders 28 to enable the taping to angle at which the guides feed the tape to the elongated conductor to be varied. The taping angle, which is the acute angle between the longitudinal axis of the conductor and the longitudinal axis of the tape, is determined by the extent or percentage of the tape partial overlap which is desired.

The guide device 20 of the invention is mounted concentrically on the winding head 21 of the wrapping machine which drives the guiding device. The winding head carries multiple tape supply package 31. Guide pins 32 for directing the different individual tapes to their respective guides 30 are pivotally mounted on support rods **21*a* extending from flange 21*b* of the winding head. The ends of support rods 21*a* are supported by capscrews 21*c* extending through holes in ring 21*d* of the winding head. Concave rollers 33 are rotatably mounted along their longitudinal axis on shafts 34**. These rollers function to support the individual tapes being delivered from the multiple tape supply package to their respective guide pins and guides.

Figure 2:
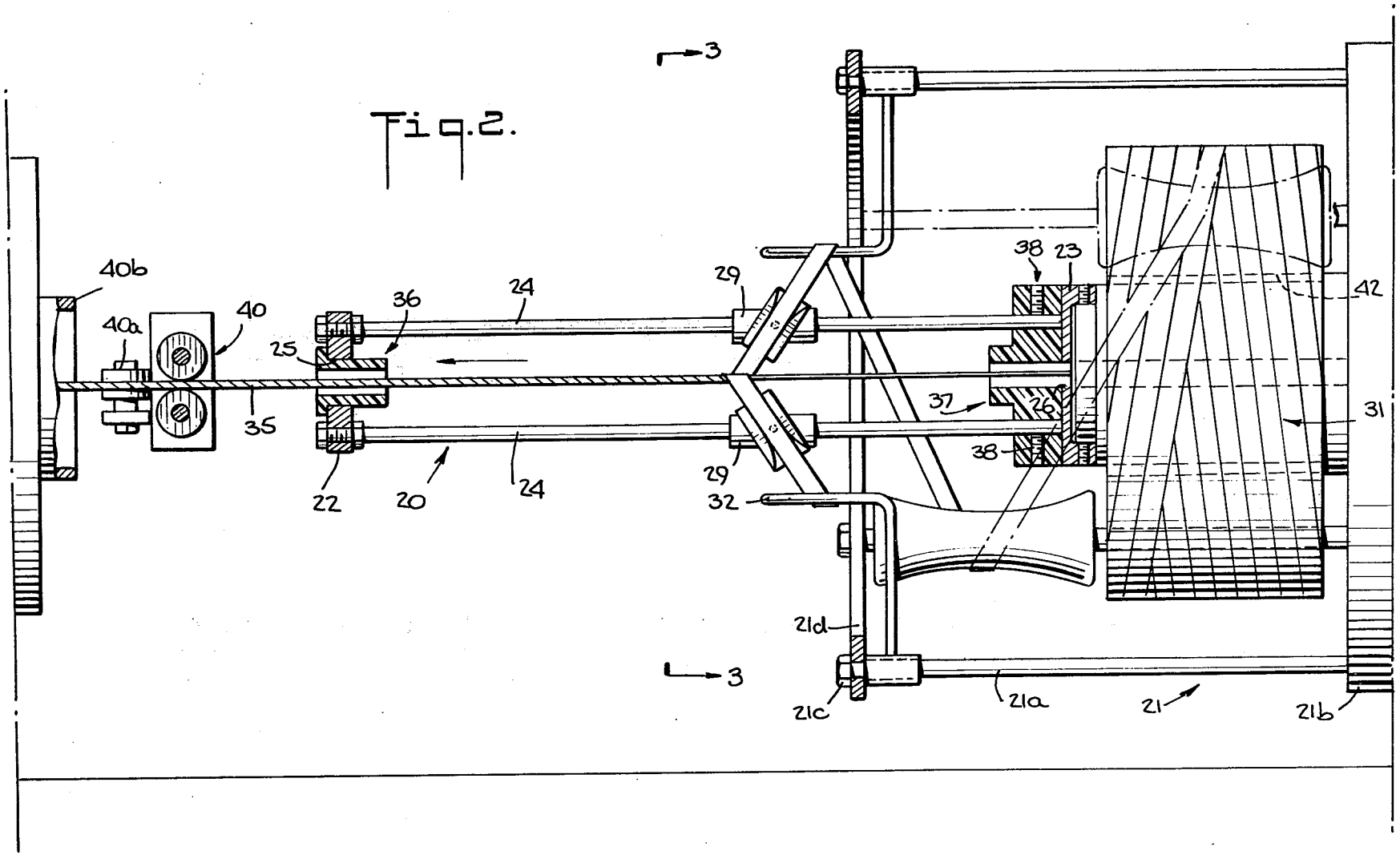
FIG. 2 is a side elevational view of the guide device with the multiple tape supply package of the invention mounted on the winding head.
Figure 7:
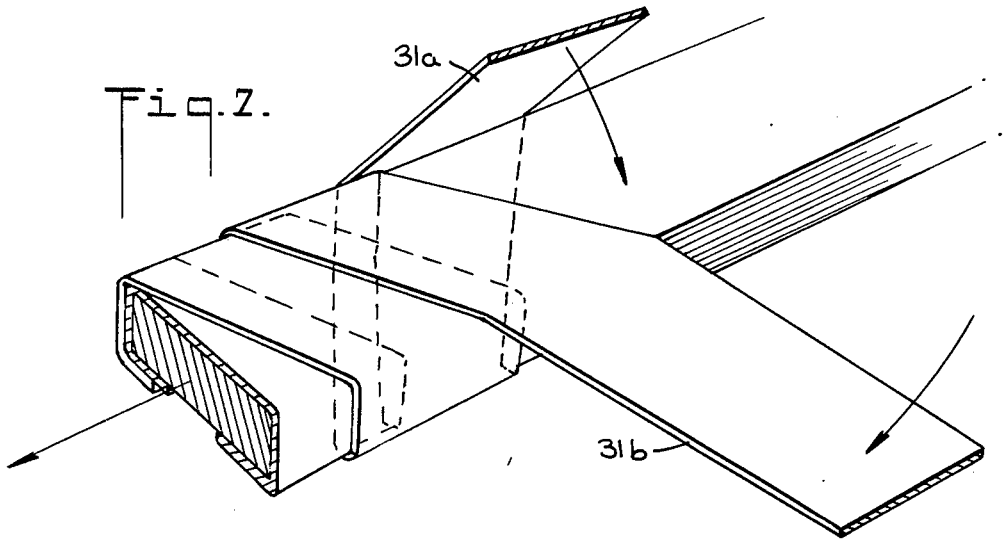
FIG. 7 is a perspective view of a section of elongated rectangular conductor being wrapped with two partially overlapping tapes applied simultaneously.

As indicated by the arrow in FIG. 2, the elongated conductor 35 being wrapped is moved along its longitudinal axis through the winding head 21 and guide device 20 by means of a driving means (not shown). Guide rollers 40 and **40*a* position and support the conductor as it advances through the guide device and into tubular support 40*b*. The driving means is located to the left of the end of support 40*a* as shown in FIG. 2. Also shown in FIG. 2 are variable length bushings of low friction material 36 and 37 located within the end plates 22 and 23** which serve to guide the elongated conductor if it should momentarily sag or otherwise approach contact with the guide device.

Referring to FIG. 3, the threading of the individual tapes can be seen. Thus, tape **31*a* is taken from the two tape supply package 31, first at point 41. It is then threaded over a pair of concave rollers 33 and is wrapped around guide pin 32 which directs the tape onto guide 30 and to the elongated conductor 35. Tape 31*b* is similarly passed over a different pair of concave rollers 33, guide pin 32, and guide 30** to the conductor.

When setting up the machine for operation, a multiple tape supply package 31 is slipped over the center spindle 42 of the winding head 21. The guide device which is secured to the center spindle 42 by means of set screws 43, as shown in FIG. 1, has an outside diameter smaller than the inside diameter of the core of the supply package. The multiple tapes are then threaded as discussed above and the ends thereof are attached to the elongated conductor by means of any suitable adhesive. The machine is then started. It should be noted that the guide device 20, guide pins 32, concave rollers 33, tape supply package 31, and the center spindle 42 of rotating head 21 are all in a fixed position relative to each other throughout the full arc of rotation about the center line of the conductor. As a result, all rotate concentrically about the longitudinal axis of the elongated conductor as the elongated conductor is pulled through the center of the rotating head by the drive means of the wrapping machine at a variable selected speed directly proportional to the rotating speed of the guide head.

Figure 4:
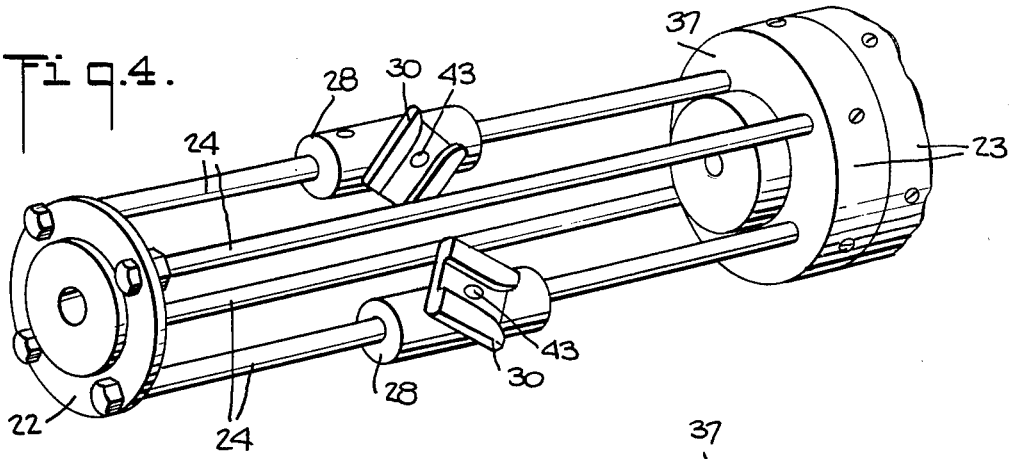
FIG. 4 is a perspective view of the guide device with two guides for simultaneously guiding two tapes from a two tape supply package.
Figure 5:
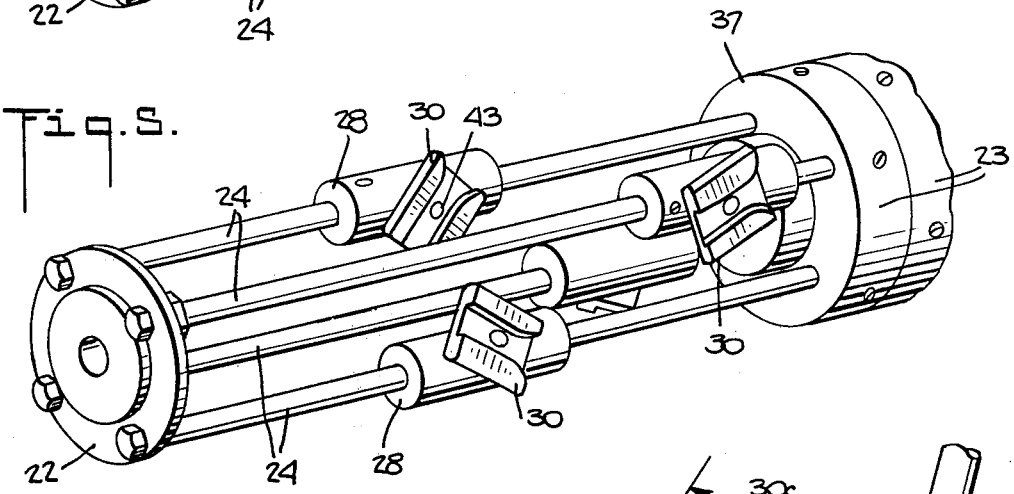
FIG. 5 is a perspective view of the guide device with four guides for simultaneously guiding four tapes from a four tape supply package.

FIG. 4 shows a two-tape guide device 20, while FIG. 5 shows a four-tape guide 20*a*. The configuration and number of support rods 24 varies as a direct function of the number of tapes on the supply package. For example, a six-tape supply package, that is a supply package having six partially overlapping tapes, would have six support rods extending between end plates 22 and 23 and spaced apart from one another by arcs of 60°. Such a configuration could also be used for a tape supply package having three partially overlapping tapes. Theoretically, such a device could be used for application of two, three, four, five or six tapes; however, as a practical matter, for better dynamic characteristics at the relatively high rotating speeds of the winding head, it is preferred to have guides 30 on guide device 20 in a symmetrical and consequently dynamically balanced configuration as shown in FIGS. 4 and 5.

The guides 30 as used in the present invention can be formed from low friction material such as nylon resin material, while the support shafts 24 can be formed of polished steel.

Figure 6:
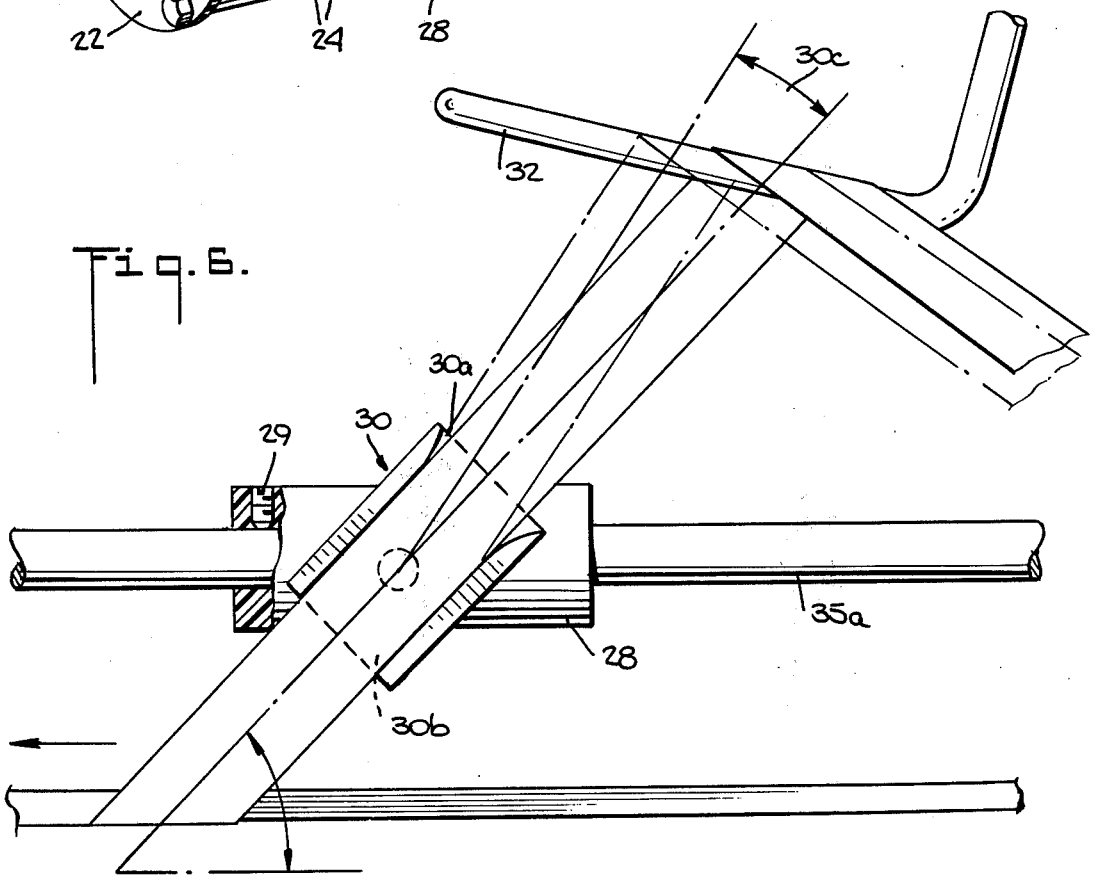
FIG. 6 is a fragmentary view of an individual guide block showing the variation of the tape delivery angle.

Referring to FIG. 6 wherein a detail view of a tape guide 30 is shown, it should be noted that the tape receiving end 30*a* of the slot 30*b* of the guide is tapered outwardly. It should also be noted that the angle at which the tape can be delivered to the guide 30 from the guide pin 32 can vary through a tape delivery angle designated 30*c*. The possible range of the tape delivery angle 30*c* from guide pin 32 is caused by the constant change of the angle of issuance of each of the multiple overlapping tapes from the supply package during operation. The change in the angle of issuance is due to the fact that the tapes are traverse wound on the supply package and the diameter of the package at any instant during unwinding affects the issuance of angle. Hence, the function of the funnel-shaped receiving end is to accommodate the variable tape delivery angle from the guide pin 32. Tape guides 30 may then deliver the tape at a constant taping angle to the elongated conductor.

The taping angle is a function of the selecting of the degree of overlap for the multiple tapes and the geometry and size of the cross-section of the conductor being wrapped.

The slot in each of guides 30 may be varied in width to fit different widths of tape. For a limited range of different uniform tape sizes, different guides 30 are made available for whatever tape size is desired. As can be seen from FIG. 4 and 5, guides 30 are secured to guide holders 28 by means of fasteners 43 and therefore can be readily interchanged.

Figure 13:
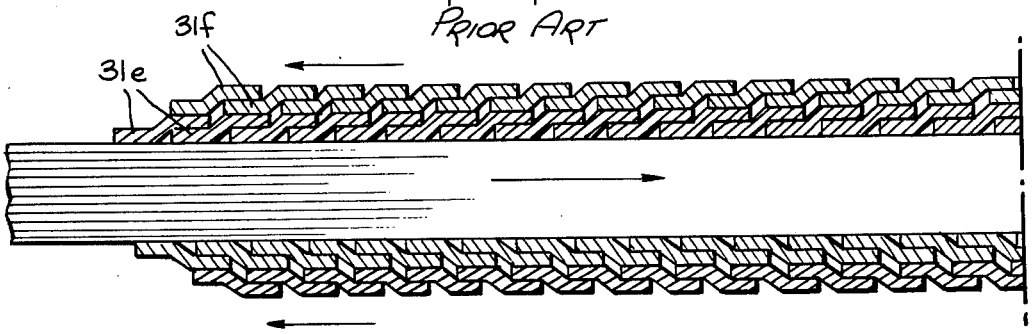
Fig. 13. PRIOR ART
FIG. 13 is a vertical section view of a first tape wrapped about an elongated conductor and a second tape wrapped about the first state by employing a method known in the prior art.
Figure 14:
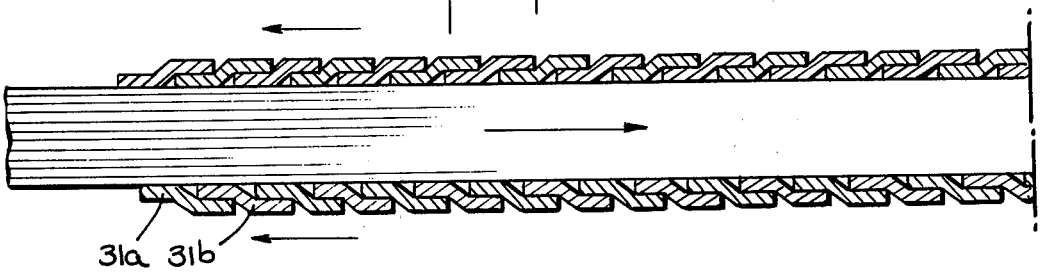
FIG. 14 is a vertical section view of an elongated conductor wrapped with two partially overlapping tapes from a traverse wound tape supply package in accordance with the invention.
Figure 15:
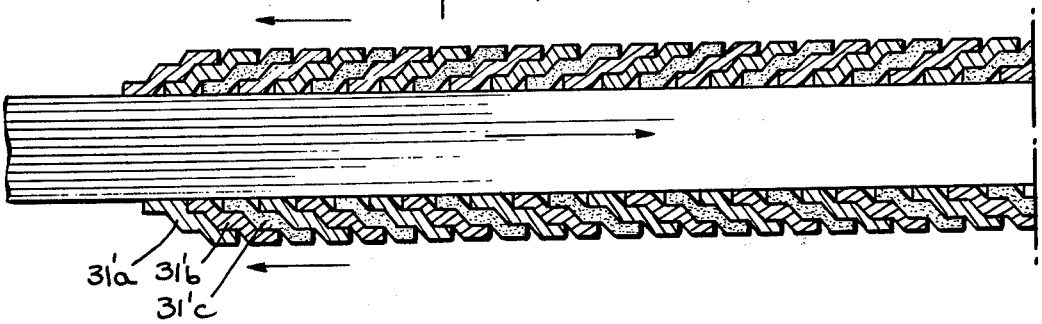
FIG. 15 is a vertical section view of an elongated conductor wrapped with three partially overlapping tapes from a traverse wound tape supply package of the invention.

By using the apparatus and method of the invention, it is possible to increase the production rate of wrapping conductors since the length of the tapes along the longitudinal axis of the conductor for each rotation of the winding head can be increased without increasing the head speed. As a result the rate of travel of the conductor through the machine is increased. The extent to which the speed of the conductor can be increased depends upon the number of tapes from the multiple tape supply package that are being simultaneously applied. For example, using a ½ inch wide single tape supply of the prior art with a selected overlap of 50% on the conductor, the conductor would advance an increment for each complete rotation of the winding head which is a function of the tape width and an inverse function of the target of the taping angle. If however, a four-tape supply package is used, in accordance with the invention, the conductor would be advanced four times the increments of the single tape for each complete rotation of the winding head, As can be seen by comparing FIGS. 13, 14, 15 and 16, a feature of the multiple tape wound conductor is that each of the multiple tapes ofthe invention are applied with a portion of each in contact with the conductor regardless of the number of tapes being applied. Thus, in each of the three constructions shown in FIGS. 14, 15 and 16, one edge portion of each tap is in contact with the surface of the bare conductor and is progressively laid over each ofthe other tapes coming from the multiple group of tapes wound on the supply package. In FIG. 13 only tape 31*e* contacts the conductor while the 31*f* simply overlies tape 31*c*.

By use of a multiple station winding machine, the output of more than one multiple tape package may be simultaneously and consecutively applied about the conductor. A double-headed machie, for example, may have on its first winding head a four-tape supply package while on its second winding head may have a three-tape supply package. The resulting number of layers of tape would be seven, the sum of a four tape construction plus a three tape construction.

Figure 16:
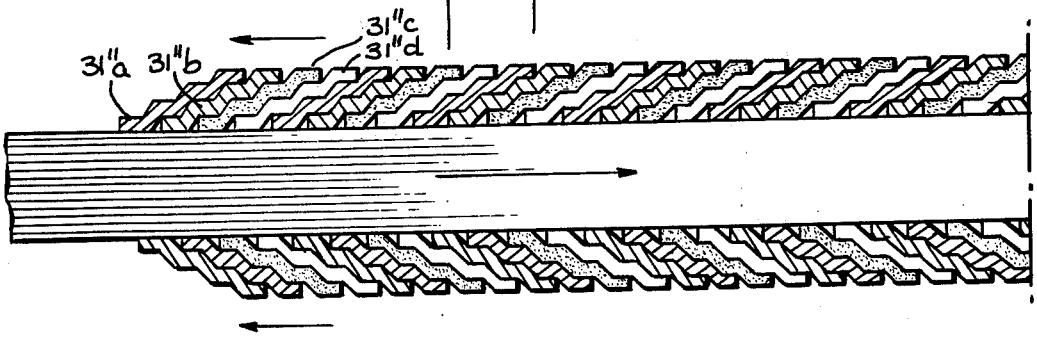
FIG. 16 is a vertical section view of an elongated conductor wrapped with four partially overlapping tapes from a traverse wound tape supply package of the invention.

FIG. 13 shows a conductor which has been double wrapped by using two single tapes of the prior art and running the conductor through the winding machine twice or through two separate winding stations or through two tape pads a single head winding machine having two tape pads either concentrically or eccentrically mounted thereon. Such a machine would overlap one tape upon another to the extent of about 50% of the width of the tape. FIG. 16 shows a conductor wrapped according to the present invention using a four-tape supply package. A comparison of the two shows that although there exists substantially the same total thickness of tape covering the conductor, the latter can be obtained by simply running the conductor through a single winding head in accordance with the invention while the arrangement of the prior art shown in FIG. 13 requires either two passes through a single winding head, through two separate winding heads, or through a winding head having two separate pads. The resulting pattern of the multiple tapes in FIG. 16 has the advantage that each of the different tapes are in engagement with all of the other tapes. The pattern has the further advantage that it can accommodate bending of the conductor because the nested multiple tapes can each comply to the movement of the others. The pattern resulting in FIG. 13 has no such engagement between the individual tapes. Instead, one tape is simply wrapped on top of the other.

By way of example, tapes used in wrapping electrical conductors for electrical power equipment have standard widths in a range extending from approximately 0.375 inches in increments of 0.125 inches. Such a range can extend up through a tape width of at least 1.250 inches. Tapes in this range of tape widths can be used with various sizes of conductors such as round conductors in a range extending upwardly from about 0.808 inches in diameter and through a range of rectangularly shaped conductors extending from about 0.124 inches wide to about 1.25 inches wide and in thickness from 0.030 inches to 0.250 inches.

Further by way of example, the conductors to be wrapped in accordance with the invention can be various round, square or rectangular conductors having cross-sectional areas in the range from about 0.0051 square inches to about 0.4420 square inches. The wrapped cable or construction of the invention is not limited to this range; however, this range is indicative of the present commercial range for tape-covered magnet wire used in industry which can be wrapped in accordance with the invention.

When wrapping an elongated conductor using a single tape supply, whether it be a flat wound or traverse, the tape will simply issue forth as needed. If an attempt was made to wrap a conductor with two different tapes from a single package on which the tapes were not simultaneously wound, an insurmountable problem would result. The problem would be that a difference in the length of the tape being taken from one of the two separate windings on a common core would result. As soon as the difference existed, either one tape would break, or slack in the other tape would result.

As is well known in the art, if two or more tapes are simultaneously wound around the core of a supply package such that they are 100% overlapping, the tap which is outside for each turn about the core would be longer than the other tape. Hence, if the multi-tape supply package described above were applied to a conductor, there would be an excess length or shortage of one tape relative to the other. This would cause an uneven winding and eventually breakage or tangling of the excess tape within the rotating head lead.

The partially overlapping multi-tape supply package of the invention has succeeded in eliminating these problems of wrapping multiple tapes from a single supply. Thus in accordance with the invention simultaneously traverse winding of multiple tapes on a single core with the same nominal degree of overlap as is to be on the wound conductor enables the multiple tapes to be wrapped without accumulating a surplus or shortage of any tape. for example, if a conductor is to be wrapped with three tapes simultaneously with each overlapping the tape adjacent thereto by one-third, then a tape supply package containing three tapes with a corresponding overlap may be used. In this way it is insured that when the three tapes are taken from the supply package they will all be of equal length.

Figure 8:
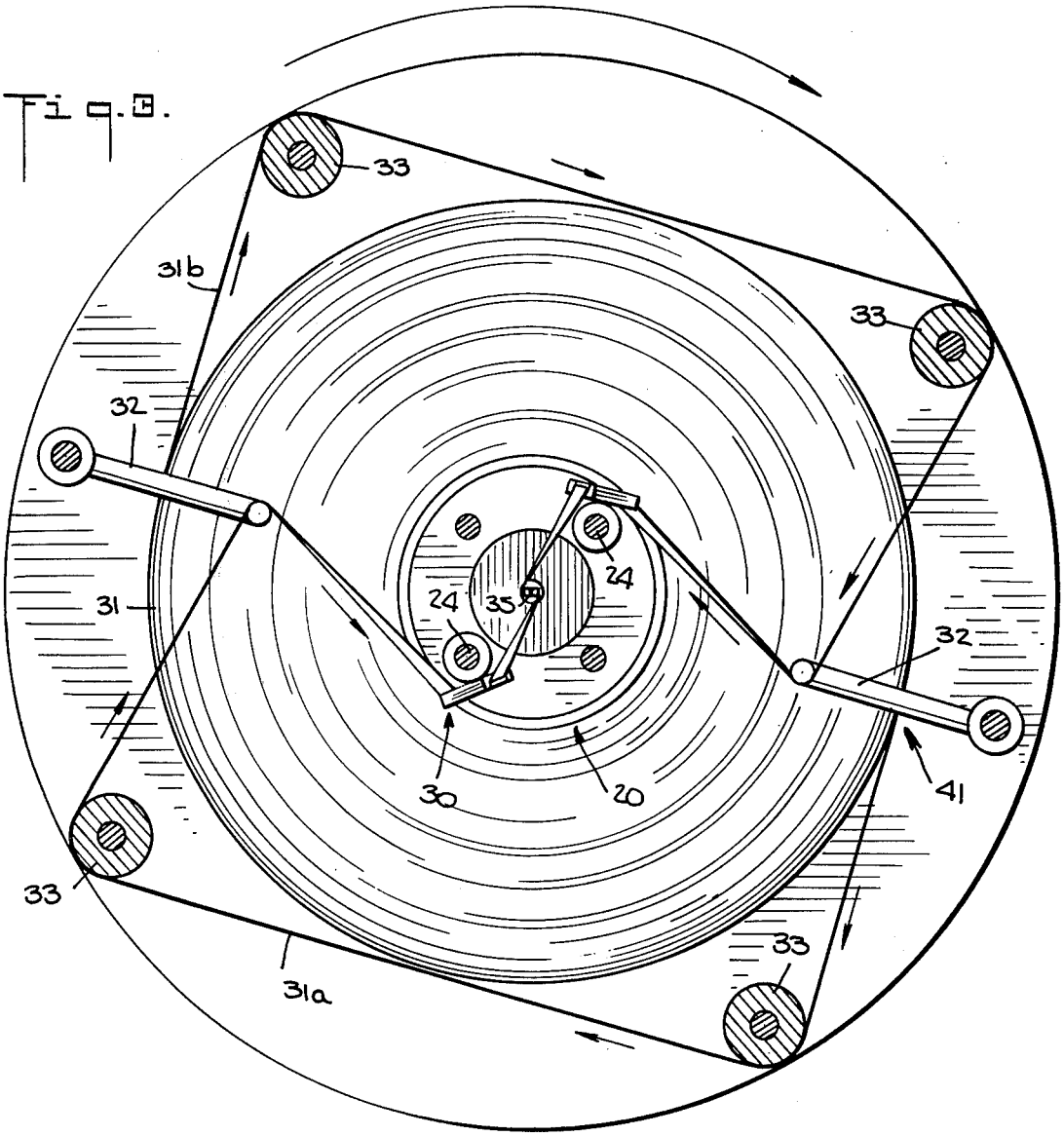
FIG. 8 is a vertical section view of a single tape flat wound tape supply pad of the prior art.
Figure 10:
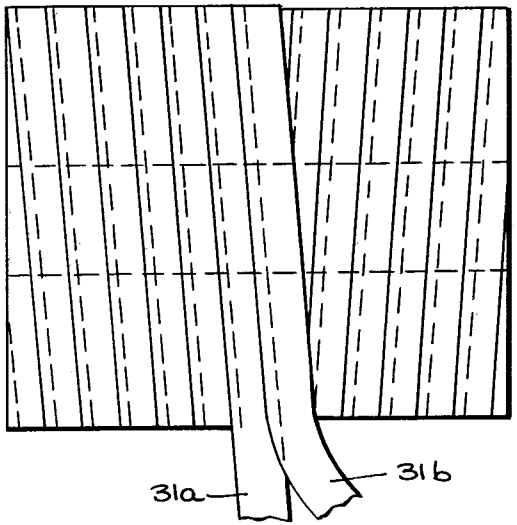
FIG. 10 is a side elevational view of a partially overlapping, two tape, traverse wound tape supply package of the invention.
Figure 9:
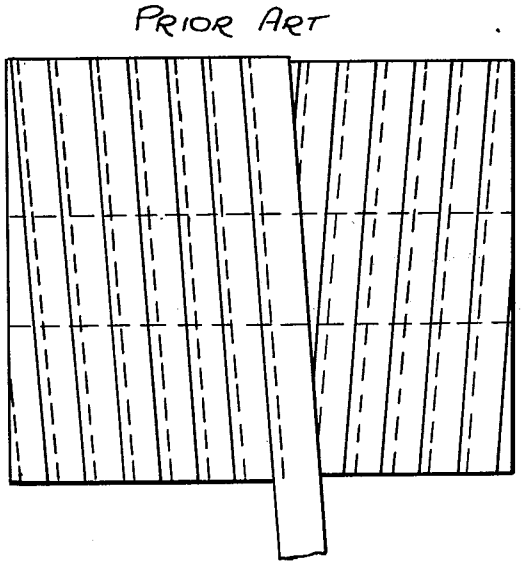
FIG. 9 is a side elevational view of a single tape traverse wound tape supply pad of the prior art.

FIG. 8 shows a prior art single tape supply pad flat wound on a hollow core. FIG. 9 depicts a prior art single tape supply pad traverse wound on a hollow core to form a spool or cop. FIG. 10 shows a two-tape partially overlapping traverse wound tape supply package 31 of the invention. In package 31 of FIG. 10, tape 31*a* is of the same length as that of tape 31*b* since neither tape 31*a* nor 31*b* in package 31 is consistently closer to the core than the other. If a pair of the prior art pads were to be used or the pad of FIG. 8 was to be provided with multiple tapes, a surplus or shortage of either tape would necessarily occur. The invention eliminates this problem.

Figure 11:
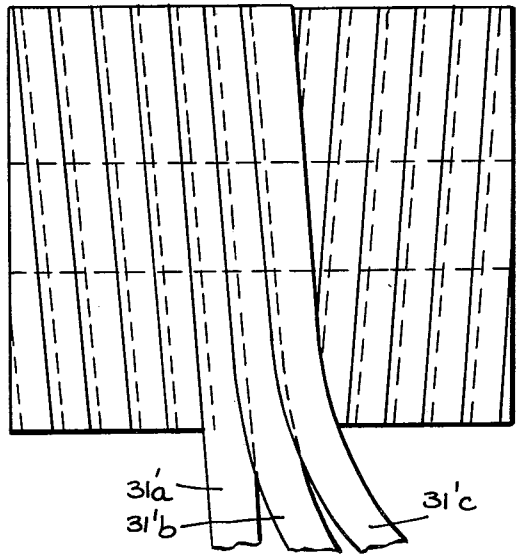
FIG. 11 is a side elevational view of a partially overlapping, three tape, traverse wound tape supply package of the invention.

FIG. 11 shows a three-tape supply package 31' of the invention. It can be seen that one part of each of individual tapes 31'*a*, 31'*b*, 31'*c* is partially overlapping the tape adjacent to it with the result that the other part of the tape is in direct contact with the layer of tapes beneath. For example, the left side of tape 31'*b* is partially overlapping the right side of tape 31'*a* as viewed in FIG. 11. Thus the right side of tape 31'*b* is in contact with the layer beneath it and is being itself overlapped by tape 31'*c*. *On the next layer of the three tapes, the left side of tape 31'a* will partially overlap the right side of tape 31'*c*. Hence all three tapes are in partial contact with the layer below and are overlapping each other in the same amount. Accordingly, all three tapes in the set are at any instant wound about the same diameter and this results in each of the tapes being of equal length.

Figure 12:
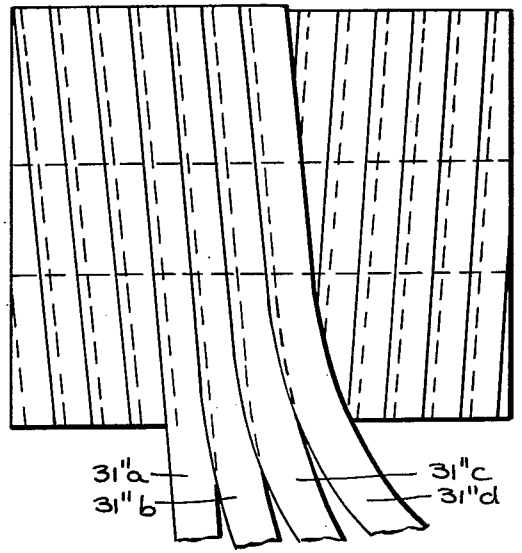
FIG. 12 is a side elevational view of a partially overlapping, four tape, traverse wound tape supply package of the invention.
Figure 8:
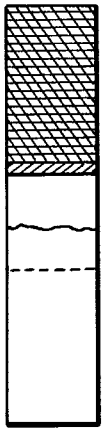

FIG. 12 shows a supply package 31'' of the present invention containing four individual tapes, all being of equal length.

Figure 17:
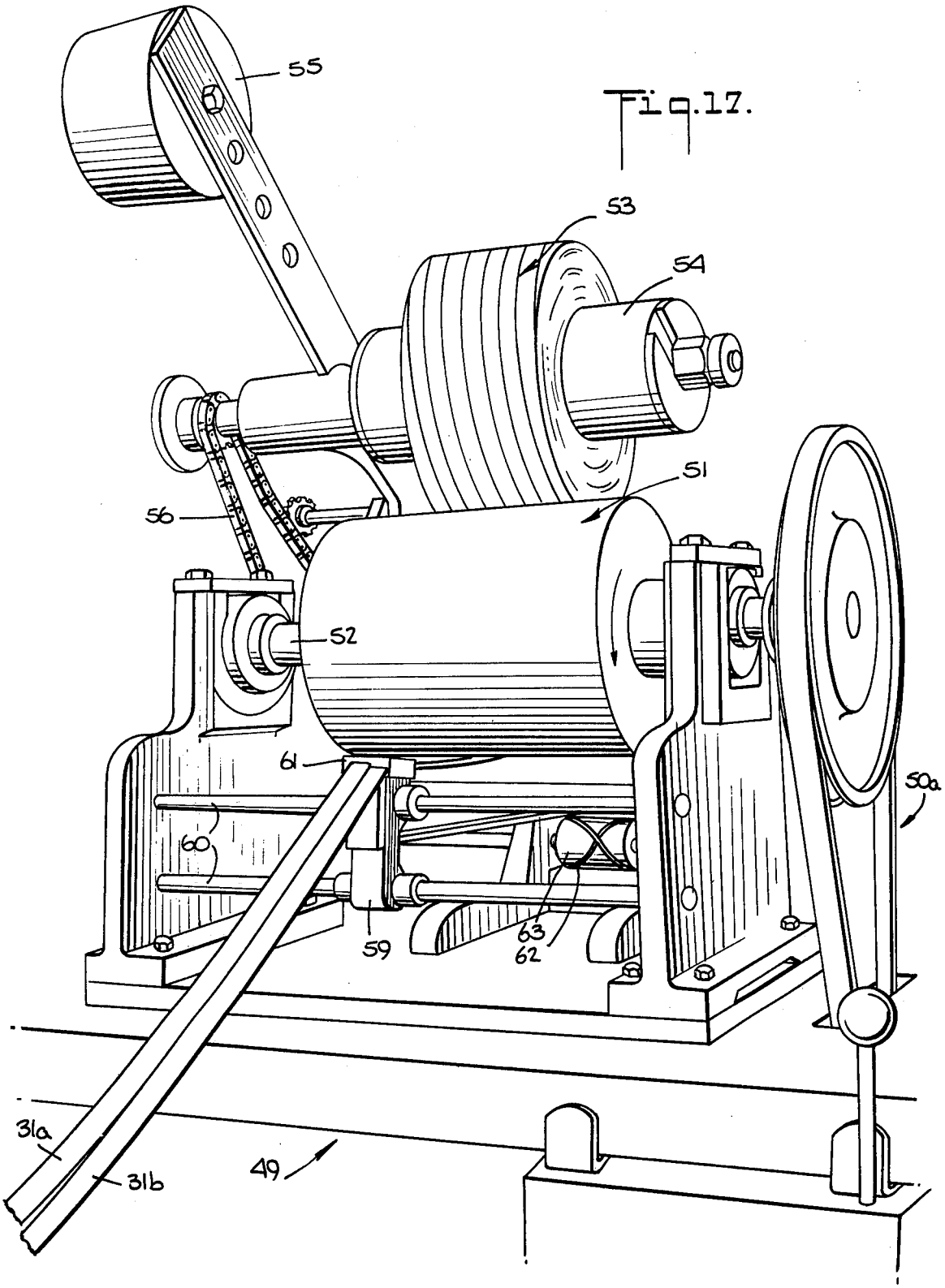
FIG. 17 is a perspective view of the front of the winding apparatus having an overlapping multi-feed head for traverse winding partially overlapping multiple tapes into the tape supply package of the invention.
Figure 18:
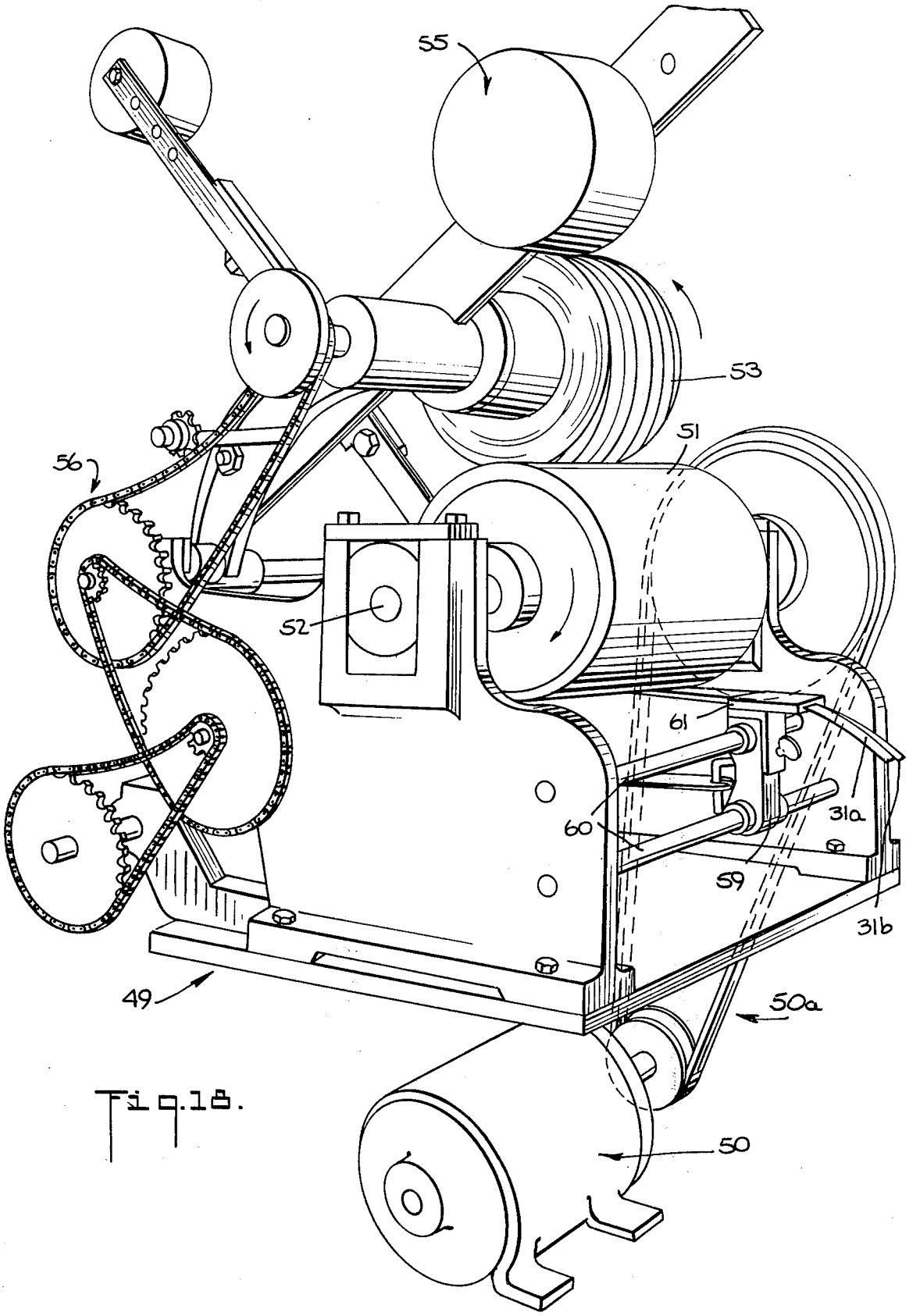
FIG. 18 is a perspective view of the side winding apparatus having an overlapping multi-feed tape head to simultaneously traverse wind partially overlapping multiple tapes into the tape supply package of the invention.
Figures 19, 20, 21, 22:
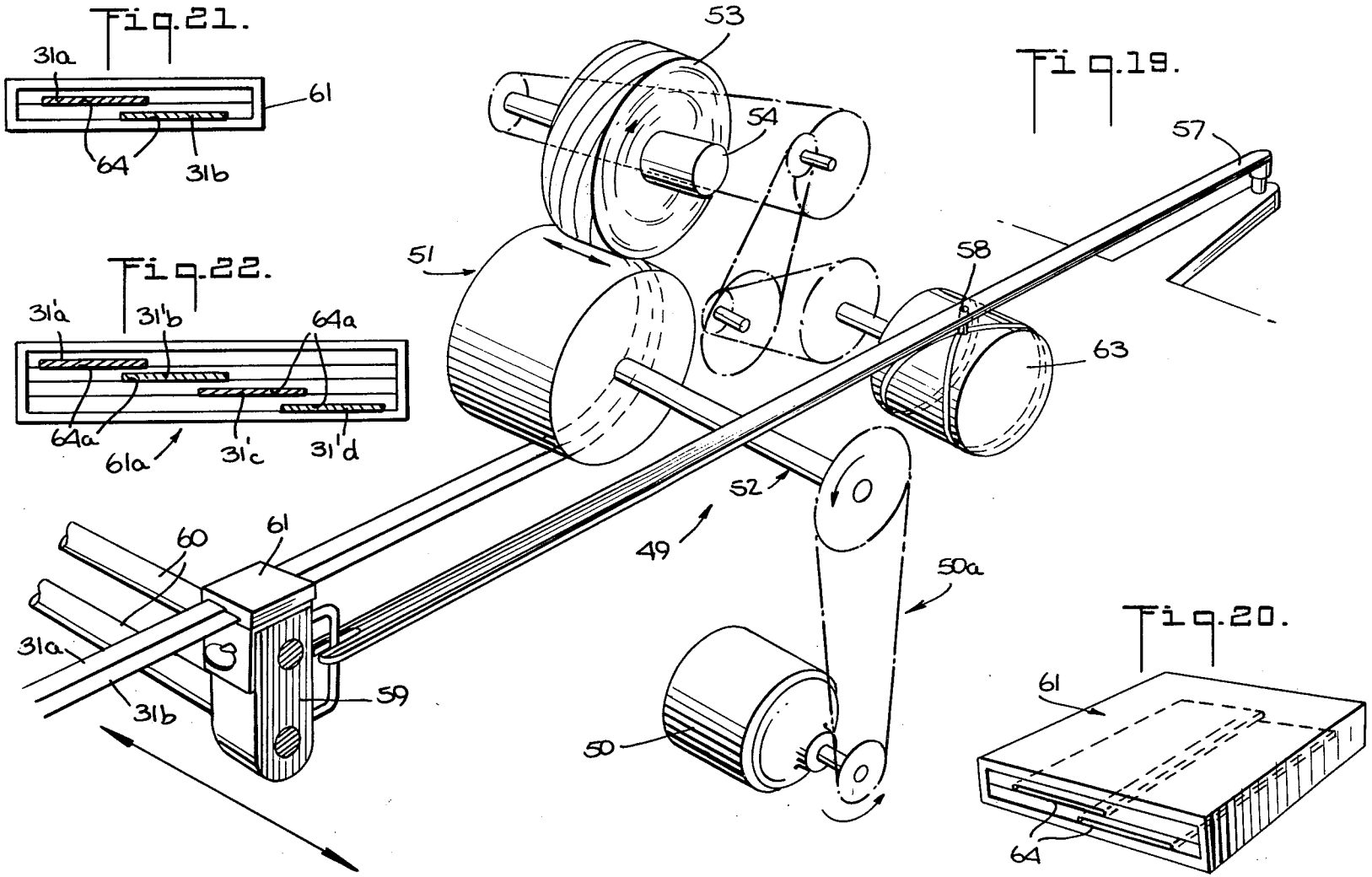
FIG. 19 is a schematic drawing of the drives of the apparatus shown in FIGS. 17 and 18.
FIG. 20 is a perspective view of the two tape feed guide of the invention.
FIG. 21 is a vertical section view of a two tape feed guide of the invention.
FIG. 22 is a vertical section view of a four tape feed guide of the invention.

FIGS. 17, 18 and 19 disclose apparatus which can be used to wind the partially overlapping, abutting or separated traverse wound, multi-tape supply package 31 of the invention. Winding machine 49 comprises a modification of a winding machine used in the prior art to traverse wind a single tape into pads. In FIGS. 17 and 18 and more particularly to FIG. 19 which is a schematic view of the tape feed of machine 49, it can be seen that power source or motor 50, by means of a belt rotates drive roller 51 by means of drive 50*a* and shaft 52. The roller 51 can be formed of rubber-like material to provide adequate friction with respect to the package to rotate it throughout the winding process. Supply package 53 is mounted on spindle 54 and is biased against the roller 51 by means of weight 55 (FIGS. 17 and 18). Spindle 54 by means of chains and sprockets 56 rotates cylindrical cam 63 which in turn transmits horizontal movement to pivotally mounted lever 57 (FIG. 19) by means of follower 58 engaged with cam track 62. Pivotally mounted lever 57 in turn moves a guide holder 59 which is slidably mounted on bars 60 (FIGS. 17, 18 and 19). Removably attached to the guide holder 59 is multiple tape guide head 61 of the invention.

Guide head 61 as shown in FIGS. 20 and 21 contains two narrow passages 64 each of which extends through the length of the head. These passages are adapted to guide the individual tapes 31*a* and 31*b* to be wound on the multiple tape supply package 31. As can be seen from FIGS. 20 and 21, the passages 64 extend through the head in different planes and are partially overlapping each other. The degree of overlap can be selected to correspond substantially to the degree of overlap of the multiple tapes when wound on the conductor. Thus guide head 61 is conditioned by not only the number of tapes to be wound on a package, but also by the amount that the tapes are to overlap each other.

In operation of the winding apparatus as shown in the drawings, two tapes are threaded through the tape guide head as shown in FIG. 19. The tapes are delivered to machine 49 from two separate supply sources (not shown) which can be flat-wound pads or rolls of tape. The tapes 31*a* and 31*b* are then threaded under drive roller 51 and between a core mounted on spindle 54 and the rear side of roller 51. The tapes are then attached to the core. The power source 50 is then energized. Since the tapes and core are forced against the rear side of drive roller 51 as seen in FIGS. 17–19, rotation of roller 51 in the direction of the arrow rotates the core by friction engagement. The rotation of the core on spindle 54 causes tapes 31*a* and 31*b* to be pulled from their individual supply packages and to be wound around the core. The individual tapes after passing through guide head 61 are aligned in a partially overlapping fashion and will be wound in that manner on the core. Guide head 61 can be formed from low friction material such as resin materials which are suitable for bearing.

At the same time as the tapes are being wound on the core, the rotation of the cam drum 63 will cause the lever 57 to move the guide head 61 back and forth across the surface of rubber roller 51. This horizontal movement will result in the tapes being traverse wound upon the core of the supply package. Since the drive to cam 63 and thereby arm 57 which carries the guide head originates with spindle 54, it can be seen that the movement of the guide head is synchronized with the surface speed of the package or the core regardless of the instantaneous diameter of the pad. In this way the number of turns of overlapping combinations of tapes is the same for all layers of the traverse wound package.

FIG. 22 depicts a four tape feed head of the present invention. By way of example, four tape packages in accordance with the invention have been prepared by the use of paper tape one-half inch in width and approximately 0.0025 inches thick. The traverse wound package is formed about a core approximately 3 inches in diameter with a package width of approximately 3½ inches and an outside diameter of approximately 8 inches. The degree of overlap of adjacent tapes can be, in the example, approximately 75 percent. An eight inch diameter package would include approximately 3300 total yards of tape. A 10½ inch package of this type would contain approximately 66 total yards while a 12½ inch package would include approximately 99 yards.

Figure 23:
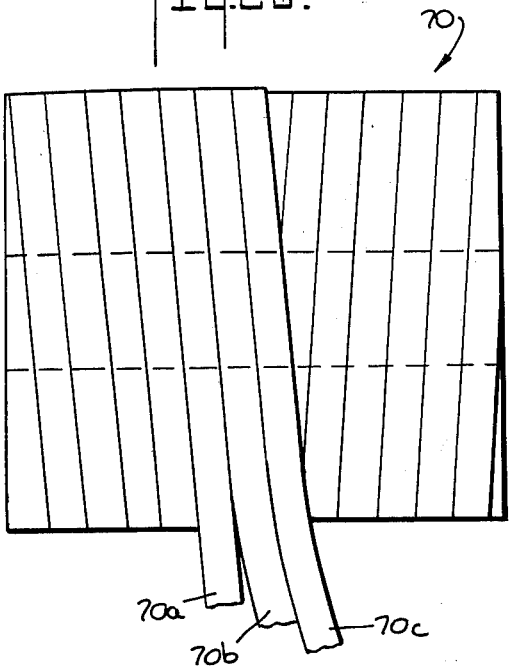
FIG. 23 is a side elevational view of a traverse wound tape supply package of the invention having a plurality of different tapes substantially abutting one another.

Further in accordance with the invention, the supply package can comprise a plurality of different tapes which are traverse wound with the edges of each different tape substantially abutting the tape adjacent thereto. Thus, the plurality of different tapes are not overlapping in the supply package. As shown in FIG. 23, supply package 70 comprises traverse wound tapes 70*a*, 70*b*, and 70*c* which have their edge portions in an abutting arrangement. Thus, in supply package 70, the plurality of tapes are not overlapping one another. Tapes 70*a–c* can be applied to an elongated conductor by the method and apparatus of the invention for wrapping tapes. In wrapping tapes 70*a–c*, the different tapes can be applied to the conductor in an abutting, separated, or overlapping arrangement as determined by the setting of the guide device of the winding head.

Figure 24:
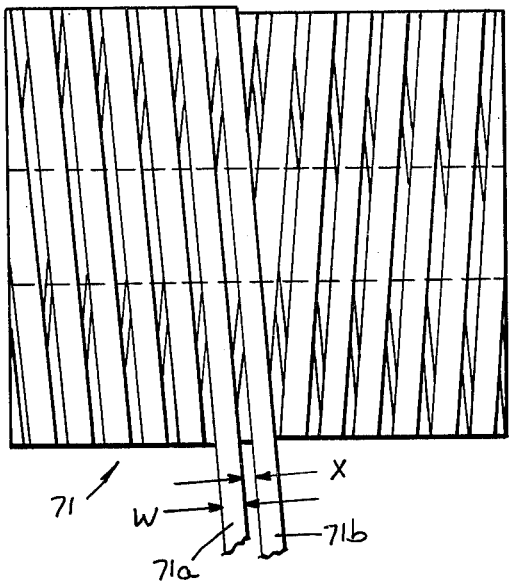
FIG. 24 is a side elevational view of a tranverse wound tape supply package of the invention in which the different tapes of the plurality of tapes are spaced from one another.

In the traverse wound supply package of the invention, the plurality of tapes making up the package can have their edge portions spaced apart from one another. As shown in FIG. 24, supply package 71 is formed by different tapes 71*a* and 71*b* which are traverse wound with their adjacent edges spaced apart from one another by an interval designated "X" in the drawing. Although it is possible for the interval X between the different tapes being traverse wound to be greater than the width of a tape designated "W" in FIG. 24, it is preferred that interval X be less than the tape width W.

Figure 25:
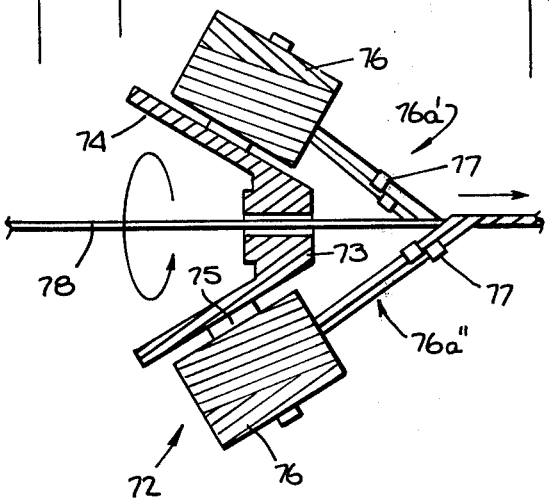
FIG. 25 is a schematic representation of a tape winding apparatus in accordance with the invention having a provision for eccentrically mounting a plurality of tape supply packages, each having a plurality of different tapes and provisions for wrapping the different tapes around a conductor.
Figure 27:
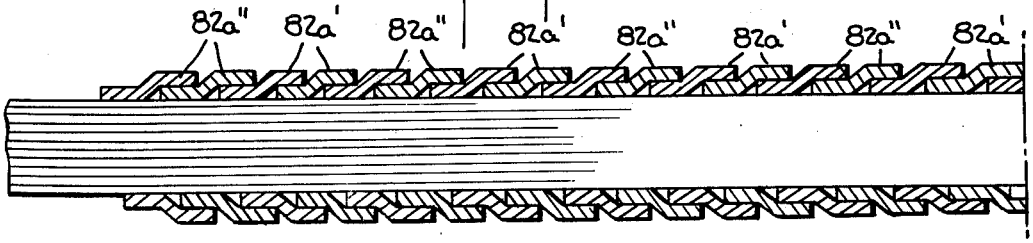
FIG. 27 is a vertical section view of an elongated conductor wrapped with two pairs of two partially overlapping tapes each from different traverse wound tapes supply packages.

In the art it is known to mount a plurality of pads of tape on a flyer or winding head eccentrically with respect to the axis of rotation of the head. In such an arrangement the plurality of flat pads have been mounted with the flat side of the pad facing the axis of rotation of the winding head and the conductor being wrapped. Thus, the axis of the pad about which the tape is wound thereon extends at substantially a right angle with respect to the axis of rotation of the head. As shown in FIG. 25, in accordance with the invention, the winding head 72 comprises a base portion 73 and supports 74 extending at a converging angle with respect to one another from the face of the base portion. Spindles 75 extend from each of supports 74 and are each adapted to support a different traverse wound multiple tape supply package 76 thereon. Guides 77 direct the plurality of tapes 76*a'* and 76*a''* from the supply packages as the plurality of tapes from each different package are simultaneously wrapped about conductor 78. The resulting configuration of tapes is shown in FIG. 27. Since supports 74 extend toward one another and at an angle to base 73, the distance which the traverse wound multiple tape supply packages extend outwardly in a radial direction can be reduced.

Figure 26:
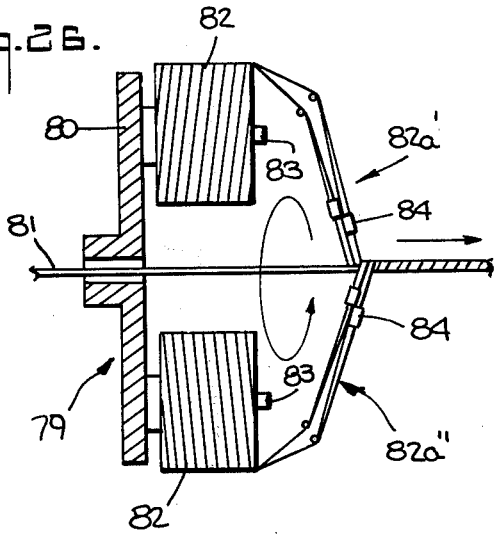
FIG. 26 is a schematic representation of a tape winding apparatus having a plurality of traverse wound tape supply packages each having a plurality of different tapes, offset from the axis of rotation of the winding head with the core of each supply package extending substantially parallel to the axis of rotation of the winding head.

As shown in FIG. 26, flyer or winding head 79 comprises base portion 80 through which conductor 81 is advanced. Winding head 79 is adapted to carry a plurality of traverse wound multiple tape packages 82 which are supported by spindles 83 extending from base portion 80. In FIG. 26, packages 82 contain a traverse wound pair of different tapes 82*a'* and 82*a''*. These different pairs of tapes can be simultaneously wrapped about the conductor 81 in an abutting, separated or overlapping arrangement.

What is claimed is:

1. A machine for wrapping tape material in a helical manner about a length of an elongated structure, the machine having a winding head with a base portion, means for driving the head about a predetermined axis of rotation extending substantially perpendicular to a predetermined surface of the base portion, the head having an opening extending therethrough along the predetermined axis of rotation, means for advancing the elongated structure to be wrapped through the opening in the head in a direction extending substantially along the predetermined longitudinal axis, means attached to the predetermined surface of the base portion of the head for supporting thereon a supply package of traverse wound tape material, the improvement comprising a plurality of means attached to the head and disposed circumferentially spaced apart from one another adjacent the periphery of the head for separating a different tape of a plurality of different tapes from a tape supply package when a tape supply package having a plurality of different tapes wound thereon is mounted on the supporting means of the head, each of the separating means causing a different one of the plurality of tapes to leave the package at a different predetermined location adjacent the periphery of the package, the line of travel of each of the plurality of tapes being separated from the package cyclically varying in direction in response to the traverse winding of the plurality of tapes on the package, and a plurality of means for guiding a different tape of a plurality of different tapes to be wrapped at a predetermined helical angle with respect to the length of the conductor and to be wrapped with respect to the tape of the plurality adjacent thereto to be in one of the predetermined conditions of spaced apart, substantially abutting, and overlapping, each of the guiding means being mounted on the head circumferentially spaced apart from one another and disposed adjacent the predetermined axis of rotation of the head at a location adjacent the portion of the means for supporting the package which portion is positioned opposite the base.

2. In a machine for wrapping tape material in accordance with claim 1 in which each of the plurality of means attached to the head and disposed circumferentially spaced apart from one anothe adjacent the periphery of the head for separating a different tape of a plurality of different tapes from a supply package having a plurality of different tapes traverse wound thereon comprises at least one spindle having its length extending substantially parallel to the axis of rotation of the head the spindle of each separating means being disposed spaced apart from the spindle of an adjacent separating means in a radial direction with respect to the axis of rotation of the head and in a predetermined circumferential location with respect to the guiding means, the spindle being substantially adjacent the outer surface of a package of tape material when mounted on the supporting means of the head, the surface of the spindle being adapted to engage a surface of the different tape and supporting the tape during the cyclically varying line of travel of the tape being separated.

3. In a machine for wrapping tape material in accordance with claim 2 in which the spindle is substantially cylindrical along its length and has a circular transverse cross section with the diameter of the cross section being maximum at the opposite ends of the spindle and minimum in the central portion thereof to provide a concave surface on the supporting member for accomodating the cyclical varying direction of the line of travel of the tape of the plurality being separated from the traverse wound supply package.

4. In a machine in accordance with claim 3 in which each spindle is pivotally mounted with respect to the head for rotation about the longitudinal axis of the spindle.

5. In a machine for wrapping tape material in accordance with claim 1 in which each of the plurality of means attached to the head and disposed circumferentially spaced apart from one another adjacent the periphery of the head for separating a different tape of a plurality of different tapes from a supply package having a plurality of different tapes traverse wound thereon comprises an elongated pin adapted to support one of the different tapes, the pin extending away from the head and the supply package supporting means thereon in a direction to which the predetermined axis of rotation extends and being disposed adjacent the guiding means for the one of the different tapes, the surface of the pin along its length being adapted to engage the surface of the different tape and support the different tape as it travels from the supply package to the guiding means for the different tape.

6. In a machine for wrapping tape material in accordance with claim 1 in which each of the plurality of means for guiding a different tape of a plurality of different tapes to be wrapped with respect to the length of the elongated structure comprises a guide member having a body portion with an elongated slot extending therethrough for receiving a tape to be guided, the slot having a width substantially corresponding to the width of the tape to be guided, and means for mounting the guide member adjacent the predetermined axis of rotation of the head and spaced radially apart from the path of travel of the elongated structure, the length of the slot disposed at a predetermined angle to the length of an elongated structure to be wrapped being substantially equal to the angle of the helix to which the tape material is to be wrapped about the elongated structure and the surface of the width of the slot extending toward and adjacent the path of travel of the elongated structure to cause the tape to be wrapped about the elongated structure by the guide member as the guide member is revolved by the head about the elongated structure.

7. In a machine for wrapping tape material in accordance with claim 6 in which the body portion adjacent the elongated slot therein is formed of low friction material.

8. In a machine for wrapping tape material in accordance with claim 6 in which the elongated slot in the body portion of the guide means is an elongated substantially U-shaped slot and in which the entrance end of the slot adapted to receive a tape to be guided from the supply package diverges outwardly toward the edge portion adjacent thereto of the guide member, the divergence of the slot providing clearance for the cyclically varying direction of the line of travel of the tape being quided.

9. In a machine for wrapping tape material in accordance with claim 6 in which the means for mounting the guide member adjacent the predetermined axis of rotation of the head and radially apart from the path of travel of an elongated structure to be wrapped pivotally mounts the guide member with respect thereto to enable the length of the slot to be disposed at a selected predetermined angle to the length of an elongated structure to be wrapped corresponding to the angle of the helix to which the tape is to be wrapped about the elongated structure.

10. In a machine for wrapping tape material in accordance with claim 6 in which the means for mounting the guide member adjacent the predetermined axis of rotation of the head and radially apart from the path of travel of the elongated structure to be wrapped movably mounts the guide member at a selected predetermined position along the length of the path of travel of the elongated structure, the selected predicted position of each different guide member being in accordance with the relative position of the tape to engage the guide member with respect to the other tapes of the plurality of tapes.

11. In a machine for wrapping tape material in accordance with claim 6 in which the means for mounting the guide member adjacent the predetermined axis of rotation of the head comprises an elongated carriage mounted on the predetermined surface of the base portion of the head and having a passage extending through the longitudinal axis thereof and adapted to be aligned with the opening in the head to enable an elongated structure to be wrapped to be advanced through the passage, the carriage having a plurality of means extending along the length of the carriage for locating a different one of the guide members, the carriage being open between the locating means to provide clearance for different tapes travelling from the guide members to the elongated structure being wrapped.

12. In a machine for wrapping tape material in accordance with claim 11 in which the plurality of means extending along the length of the carriage for locating a different one of the guide members comprises a plurality of rods mounted on the predetermined surface of the head and spaced apart from one another along their length, and a plurality of means slidingly attached to different rods and partially coupled to the different guide member for positioning the different guide member at a selective position thereon.

13. A machine for wrapping tape material in accordance with claim 12 in which the means extending along the length of the carriage for locating the guide members further comprises a pair of circular end plates each having a bore extending axially through its center, each plate being attached to different ends of the plurality of rods and extending traversely with respect to the length of the rods with the faces of the plates being substantially parallel to each other and the bores therein axial alignment, the bores being adapted to clear an elongated structure to be wrapped when extending therethrough.

14. A machine for wrapping tape material in a helical manner about a length of an elongated structure, the machine having a winding head with a base portion, means for driving the head about a predetermined axis of rotation extending substantially perpendicular to a predetermined surface of the base portion, the head having an opening extending therethrough along the predetermined axis of rotation, means for advancing the elongated structure to be wrapped through the opening in the head in a direction extending substantially along the predetermined longitudinal axis, the improvement comprising means attached to the predetermined surface of the base portion of the head for pivotally supporting thereon a plurality of supply packages of traverse wound tape material spaced apart from one another about the head, the pivotal axis of each supply package extending substantially in the direction toward which the predetermined axis of rotation extends, a plurality of means attached to the head and disposed circumferentially spaced apart from one another adjacent the periphery of the head for separating a different tape of a plurality of different tapes from a tape supply package when a tape supply package having a plurality of different tapes wound thereon is mounted on the supporting means of the head, each of the separating means causing a different one of the plurality of tapes to leave the package at a different predetermined location on the periphery of the package, the line of travel of each of the plurality of tapes being separated from the package cyclically varying in direction in response to the traverse winding of the plurality of tapes on the package, and a plurality of means for guiding a different tape of a plurality of different tapes to be wrapped at a predetermined helical angle with respect to the length of the conductor and to be wrapped with respect to the tape of the plurality adjacent thereto in one of the predetermined conditions of spaced apart, substantially abutting, and overlapping, each of the guiding means being mounted on the head circumferentially spaced apart from one another and disposed adjacent the predetermined axis of rotation of the head at a location adjacent the portion of the means for supporting the package which portion is positioned opposite the base.

15. In a machine for wrapping tape material in accordance with claim 14 in which each of the plurality of means for guiding a different tape of a plurality of different tapes to be wrapped with respect to the length of the elongated structure comprises a guide member having a body portion with an elongated slot extending therethrough for receiving a tape to be guided, the slot having a width substantially corresponding to the width of the tape to be guided, and means for mounting the guide member adjacent the predetermined axis of rotation of the head and radially apart from the path of travel of the elongated structure, the length of the slot being disposed at a predetermined angle to the length of an elongated structure to be wrapped which predetermined angle is substantially equal to the angle of the helix to which the tape material is to be wrapped about the elongated structure, the surface of the width of the slot extending toward adjacent the path of travel of the elongated structure to cause the tape to be wrapped about the elongated structure by the guide member as the guide member is revolved by the head about the elongated structure.

16. Apparatus for guiding each different tape of a plurality of tapes to be wrapped in a helical manner about a length of an elongated structure by a winding machine having a winding head with a base portion, means for driving the head about a predetermined axis of rotation extending substantially perpendicular to a predetermined surface of the base portion, the head having an opening extending therethrough along the predetermined axis of rotation, means for advancing the elongated structure to be wrapped through the opening in the head in a direction extending substantially along the predetermined longitudinal axis, means attached to the predetermined surface of the base portion of the head for supporting thereon a supply package of traverse wound tape material, and a plurality of means attached to the head and disposed circumferentially spaced apart from one another adjacent the periphery of the head for separating a different tape of a plurality of different tapes from a tape supply package when a tape supply package having a plurality of different tapes wound thereon is mounted on the supporting means of the head, each of the separating means causing a different one of the plurality of tapes to leave the package at a different predetermined location adjacent the periphery of the package, the line of travel of each of the plurality of tapes being separated from the package cyclically varying in direction in response to the traverse winding of the plurality of tapes on the package, and the apparatus comprising a plurality of guide members for guiding a different tape of a plurality of different tapes to be wrapped at a predetermined helical angle with respect to the length of an elongated structure and to be wrapped with respect to the tape of the plurality adjacent thereto to be in one of the predetermined conditions of spaced apart, substantially abutting, and overlapping, each of the guiding means being mounted on the head circumferentially spaced apart from one another, and means for mounting the guide members on the head adjacent the predetermined axis of rotation of the head at a location adjacent the portion of the means for supporting the package which portion is positioned opposite the base.

17. In a machine for wrapping tape material in accordance with claim 16 in which each of the plurality of guide members has a body portion with an elongated slot extending therethrough for receiving a tape to be guided, the slot having a width substantially corresponding to the width of the tape to be guided, and in which the means for mounting the guide member mounts the guide members spaced axially apart from the path of travel of the elongated structure, the length of the slot disposed at a predetermined angle to the length of an elongated structure to be wrapped being disposed at a predetermined angle substantially equal to the angle of the helix to which the tape material is to be wrapped about the elongated structure and the surface of the width of the slot extending toward adjacent the path of travel of the elongated structure to cause the tape to be wrapped about the elongated structure by the guide member as the guide member is revolved by the head about the elongated structure.

18. In a machine for wrapping tape material in accordance with claim 17 in which the elongated slot in the body portion of the guide means is an elongated substantially U-shaped slot and in which the entrance end of the slot adapted to receive a tape to be guided from the supply package diverges outwardly toward the edge portion adjacent thereto of the guide member, the divergence of the slot providing clearance for the cyclically varying direction of the line of travel of the tape being guided.

19. In a machine for wrapping tape material in accordance with claim 17 in which the means for mounting the guide member adjacent the predetermined axis of rotation of the head and radially apart from the path of travel of an elongated structure to be wrapped pivotally mounts the guide member with respect thereto to enable the length of the slot to be disposed at a selected predetermined angle to the length of an elongated structure to be wrapped corresponding to the angle of the helix to which the tape is to be wrapped about the elongated structure.

20. In a machine for wrapping tape material in accordance with claim 17 in which the means for mounting the guide member adjacent the predetermined axis of rotation of the head comprises an elongated carriage mounted on the predetermined surface of the base portion of the head and having a passage extending through the longitudinal axis thereof and adapted to be aligned with the opening in the head to enable an elongated structure to be wrapped to be advanced through the passage, the carriage having a plurality of means extending along the length of the carriage for locating a different one of the guide members, the carriage being open between the locating means to provide clearance for different tapes travelling from the guide members to the elongated structure being wrapped.

21. In a machine for wrapping tape material in accordance with claim 20 in which the plurality of means extending along the length of the carriage for locating a different one of the guide members comprises a plurality of rods mounted on the predetermined surface of the head and spaced apart from one another along their length, and a plurality of means slidingly attached to different rods and partially coupled to the different guide member for positioning the different guide member at a selective position thereon.

22. A method of wrapping tape material in a helical manner about a length of an elongated structure with a plurality of different tapes from at least one tape supply package having a plurality of different tapes traverse wound thereon, the method comprising the steps of:

a. advancing the elongated structure to be wrapped in a predetermined direction;

b. rotating the supply package with respect to the line of advancement of the elongated structure;

c. separating a different one of the plurality of tapes from the tapes from the tape supply package, the separating causing a different one of the plurality of tapes to leave the package at a different predetermined location on the periphery of the rotating package;

d. guiding a different tape of the plurality of different tapes from the supply package toward the elongated structure to be wrapped thereabout, the different tape being guided to be wrapped at predetermined helical angle with respect to the length of the elongated structure and to be wrapped with respect to the tape of the plurality adjacent thereto in one of the predetermined conditions of the different tapes of the plurality being spaced apart, substantially abutting, and overlapping; and e. wrapping the different tapes of the plurality of tapes being guided in one of the predetermined conditions of the tape of the plurality being spaced apart substantially abutting, and overlapping.

23. A method of wrapping tape material in accordance with claim 22 in which the step of rotating the supply package comprises rotating the supply package with the central axis the length of the supply package disposed along the line of advancement of the elongated structure.

24. A method of wrapping tape material in accordance with claim 22 in which the step of rotating the supply package comprises rotating the supply package with the central axis of the length thereof disposed offset from and substantially parallel to the line of advancement of the elongated structure.

25. A method of wrapping tape material in accordance with claim 22 in which the step of wrapping comprises wrapping the different tapes of the plurality with the predetermined condition of the tapes of the plurality being spaced apart by an interval less than the width of the tape.

26. A method of wrapping tape material in accordance with claim 22 in which the step of wrapping comprises wrapping the different tapes of the plurality in the predetermined condition of the different tapes of the plurality overlapping the tape adjacent thereto to an extent less than the width of the tape.

* * * * *